US006158406A

United States Patent [19]

Sunnarborg

[11] Patent Number: 6,158,406

[45] **Date of Patent: *Dec. 12, 2000**

[54] QUICK RELEASE ENGINE CYLINDER

[76] Inventor: Duane A. Sunnarborg, 1123 Lucille St., Livermore, Alameda County, Calif. 94550

[ * ] Notice: This patent issued on a continued prosecution application filed under 37 CFR 1.53(d), and is subject to the twenty year patent term provisions of 35 U.S.C. 154(a)(2).

[21] Appl. No.: 08/902,376

[22] Filed: Jul. 29, 1997

[51] Int. Cl.[7] ..... F01P 3/02

[52] U.S. Cl. ..... 123/193.2

[58] Field of Search ..... 123/193.2, 193.3, 123/193.1

[56] References Cited

U.S. PATENT DOCUMENTS

| | | | |
|---|---|---|---|
| 4,582,028 | 4/1986 | Wagner et al. | 123/193.3 |
| 4,709,105 | 11/1987 | Leydorf et al. | 123/193.3 |
| 4,763,619 | 8/1988 | Eitel | 123/193.3 |

OTHER PUBLICATIONS

Espey, C., Dec, J.E., "Diesel Engine Combustion Studies in a Newly Designed Optical Access Engine Using High–Speed Visualization and 2–D Laser Imaging" SAE Intl. Tech Series 930971, International Congress and Expostion, Mar. 1–5, 1993.

*Primary Examiner*—Marguerite McMahon
*Attorney, Agent, or Firm*—V. Gerald Grafe

[57] ABSTRACT

A quick release engine cylinder allows optical access to an essentially unaltered combustion chamber, is suitable for use with actual combustion processes, and is amenable to rapid and repeated disassembly and cleaning. A cylinder member, adapted to constrain a piston to a defined path through the cylinder member, sealingly engages a cylinder head to provide a production-like combustion chamber. A support member mounts with the cylinder member. The support-to-cylinder mounting allows two relationships therebetween. In the first mounting relationship, the support engages the cylinder member and restrains the cylinder against the head. In the second mounting relationship, the cylinder member can pass through the support member, moving away from the head and providing access to the piston-top and head.

11 Claims, 5 Drawing Sheets

QUICK RELEASE ENGINE CYLINDER

This invention was made with Government support under Contract DE-AC04-94AL85000 awarded by the U.S. Department of Energy. The Government has certain rights in the invention.

BACKGROUND OF THE INVENTION

This invention relates to the field of internal combustion engine instrumentation, specifically the field of engine cylinders adapted for optical instrumentation and ease of access and cleaning.

Further improvements to the performance of internal combustion engines require greater understanding of the physical processes that occur within the combustion chamber. Those physical processes are difficult to study because they are extremely complicated and highly three dimensional. Improved experimental tools can enable more complete study of the processes.

The combustion chamber precludes the use of many diagnostic tools. The conditions within the chamber are hostile to many instruments, and the presence of an instrument can disturb the process being observed. Physical access to the chamber is typically limited. Consequently, optical diagnostics are often used in place of other approaches.

Researchers have added windows to existing engines for point measurements or to introduce an external light source. Some have added flat windows to the top of the chamber. See, e.g., Witze and Dyer, "Laser Measurement Techniques Applied to Turbulent Combustion in Piston Engines," Experiments in Fluids, 4, 1986, pp. 81–92. Another used a square bore engine to maximize window space. See Namazian et al., "Schlieren Visualization of the Flow and Density Fields in the Cylinder of a Spark Ignition Engine," SAE Paper 800044, 1980. Modifying the shape of the combustion chamber to accommodate windows creates a combustion chamber with unique flow fields, useful for studying processes but not directly applicable to the study of processes in production engines.

Other researchers have used transparent cylinders to allow flow visualization. See Bates, "A Transparent Engine for Flow and Combustion Visualization Studies," SAE Paper 880520, 1988. The transparent cylinder was made of a single sapphire crystal, and was used for flow visualization.

Bowditch added a window to the top of a piston. See Bowditch, "A New Tool for Combustion Research—A Quartz Piston Engine," SAE Transactions, 69, 1961, pp. 17–23. Modifications to allow a piston-top window do not alter the chamber processes as much as modifications to the chamber's top or shape. Certain combustion processes, for example those during cold starts, result in significant soot formation. The engine must be repeatedly disassembled for cleaning the piston-top window, making Bowditch's engine cumbersome for study of such processes.

Accordingly, there remains a continuing need for a cylinder that allows optical access to an essentially unaltered combustion chamber, suitable for use with actual combustion processes, that is amenable to rapid and repeated disassembly and cleaning.

SUMMARY OF THE INVENTION

The present invention provides a quick release engine cylinder that allows optical access to an essentially unaltered combustion chamber, suitable for use with actual combustion processes, that is amenable to rapid and repeated disassembly and cleaning. The invention comprises a cylinder member adapted to constrain a piston to a defined path through the cylinder member. The cylinder member sealingly engages a cylinder head to provide a production-like combustion chamber. A support member mounts with the cylinder member. The support member-to-cylinder member mounting allows two relationships therebetween. In the first mounting relationship, the support member engages the cylinder member and restrains the cylinder member against the cylinder head, forming, with the top of the piston, a closed combustion chamber. In the second mounting relationship, the cylinder member can pass through the support member, moving away from the cylinder head and providing physical access to the top of the piston and to the combustion chamber surfaces of the cylinder head. Alternatively, an additional intermediate support member can support the cylinder member and mount with the support member. The intermediate support member can have two mounting relationships with the support member, similar to those discussed above for the support member-to-cylinder member mounting.

Advantages and novel features will become apparent to those skilled in the art upon examination of the following description or may be learned by practice of the invention. The objects and advantages of the invention may be realized and attained by means of the instrumentalities and combinations particularly pointed out in the appended claims.

DESCRIPTION OF THE FIGURES

The accompanying drawings, which are incorporated into and form part of the specification, illustrate embodiments of the invention and, together with the description, serve to explain the principles of the invention.

DETAILED DESCRIPTION OF THE INVENTION

The present invention provides a quick release engine cylinder that allows optical access to an essentially unaltered combustion chamber, suitable for use with actual combustion processes, that is amenable to rapid and repeated disassembly and cleaning.

Figure 1:
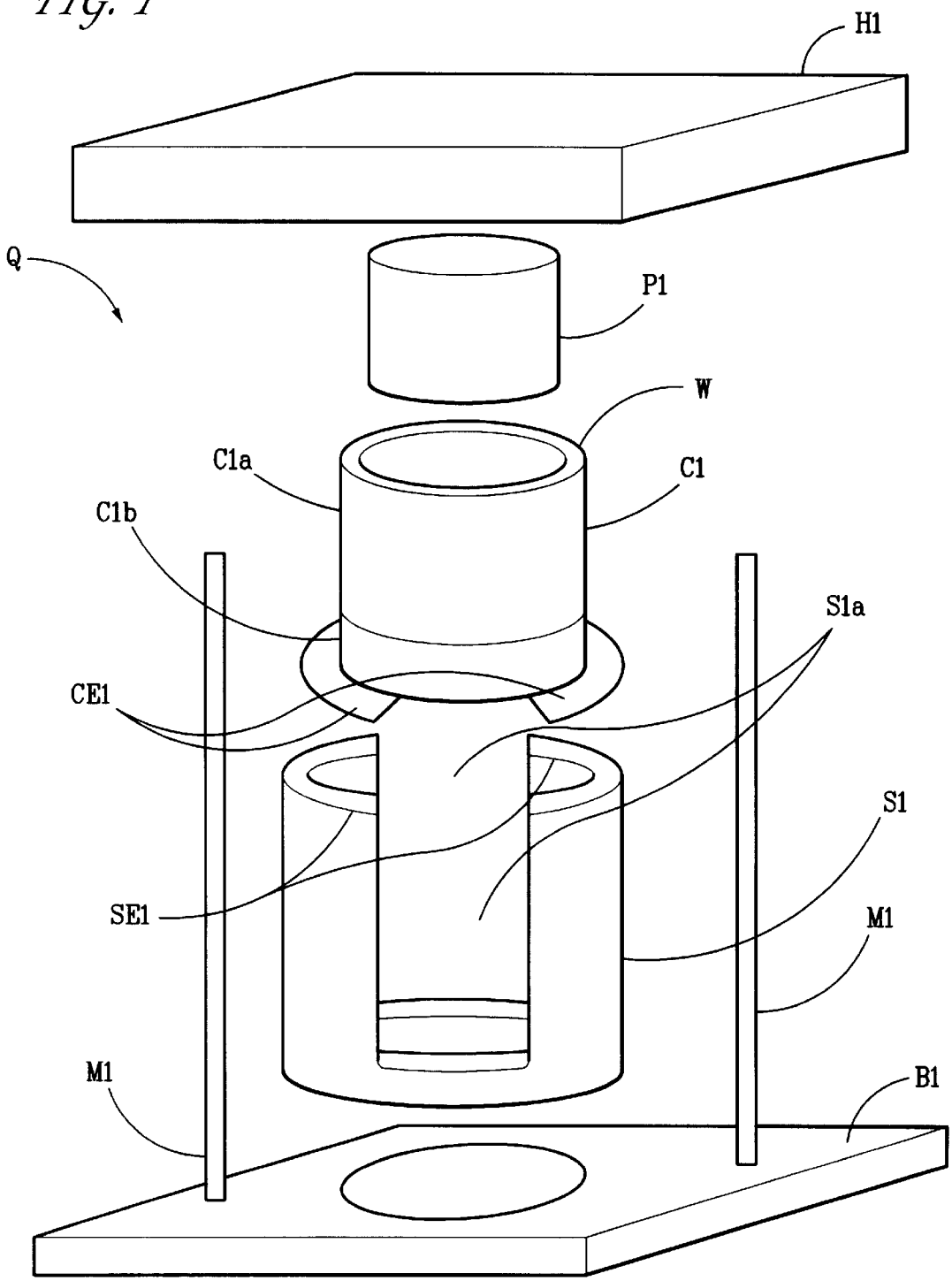
FIG. 1 is an exploded schematic of an engine according to the present invention.

FIG. 1 is an exploded schematic of a quick release engine cylinder Q according to the present invention. Quick release engine cylinder Q comprises a cylinder head H1, a piston P1, a hollow cylinder C1, support member S1, base B1, and connectors M1. Piston P1 is typically cylindrical in shape and has an outer diameter sized to allow it to move longitudinally through the inner diameter of cylinder C1. Support member S1 and connectors M1 are adapted to longitudinally align and sealingly engage cylinder C1 and support member S1 between head H1 and base B1.

Hollow interior of cylinder C1 forms a combustion chamber, bounded by head H1 and the upper surface of piston P1. Piston P1 can be made of optically transmissive material or can include a window to allow optical access to the combustion chamber. Cylinder C1 can also be made of optically transmissive material or include a window to allow optical access to the combustion chamber. Cylinder C1 can also include fluid passages through its walls W for cooling or cleaning. Intake valves or injectors (not shown) mount with head H1 to allow fuel and air into the combustion chamber. Exhaust valves (not shown) mount with head H1 to allow waste products of combustion to escape the combustion chamber. A connecting rod (not shown) attached to the piston P1 thus allows the apparatus to operate as an engine by stroking the piston P1 within the combustion chamber.

A first end of support member S1 mounts coaxially with cylinder C1. Support member S1 is adapted to prevent cylinder C1 from passing through the first end of support member S1 when cylinder C1 is at a first azimuthal orientation relative to support member S1. As an example, cylinder C1 can comprise ears CE1 that extend radially from the lower end of cylinder C1, as shown in FIG. 1. Ears CE1 rest on lands SE1 on the upper portion of support member S1. Support member S1 is also adapted to allow at least a portion of cylinder C1 to pass longitudinally through the first end of support member S1 and nest within support member S1. As an example, support member S1 can comprise longitudinal slots S1*a,* sized to provide space for ears CE1 to pass longitudinally therethrough. When cylinder C1 is at the first orientation, wherein ears CE1 align azimuthally with lands SE1 of support member S1, cylinder C1 sealingly engages head H1. When cylinder C1 is at a second orientation, wherein ears CE1 align azimuthally with slots S1*a,* cylinder C1 can disengage from head H1 and drop into support member S1, allowing access to piston P1 as well as the interior surfaces of head H1 and cylinder C1 that form the combustion chamber. Cylinder C1 can comprise two subparts C1*a,* C1*b.* Allowing subpart C1*b* to rotate relative to subpart C1*a,* allows cylinder C1 to be lowered into support member S1 without requiring rotation of subpart C1*a* (obviating difficulties posed by fluid connections to a rotating subpart C1*a*).

Figure 2A:
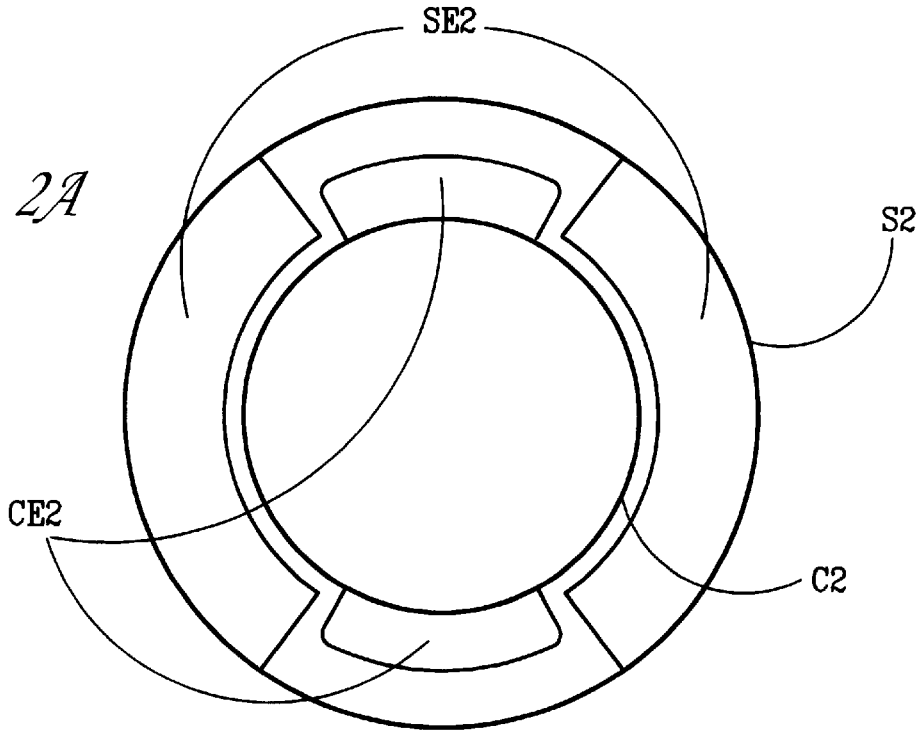
FIGS. 2(*a, b*) is a top view of a cylinder-to-support mounting according to the present invention.
Figure 2B:
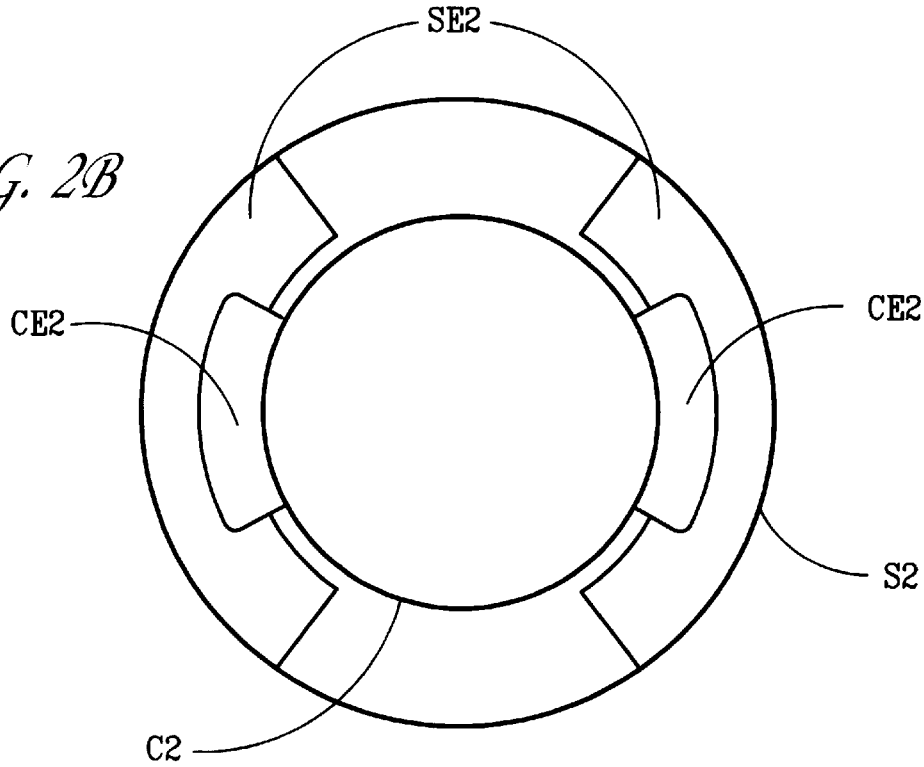

FIGS. 2(*a, b*) shows an end view of an example of a cylinder-to-support mounting according to the present invention. Support member S2 comprises a generally cylindrical open interior, sized to allow a generally cylindrical cylinder C2 to pass longitudinally therethrough and nest inside. One end of cylinder C2 can include a plurality of ears CE2 projecting radially away from generally cylindrical cylinder C2. Ears CE2 can be large and evenly distributed about the exterior circumference of one end of cylinder C2 to minimize stress concentrations which could distort or damage cylinder C2. Alternatively, a separate intermediate support (not shown) can comprise a first end adapted to support cylinder C2 and a second end having a plurality of ears projecting away from cylinder C2. A corresponding end of support member S2 can have lands SE2 projecting into the generally cylindrical open interior of support member S2. Alternatively, the end of support member S2 can comprise walls with slots matching ears CE2. In FIG. 2*b,* cylinder C2 and support member S2 are at a relative rotational orientation where lands SE2 and ears CE2 engage. Cylinder C2 consequently is prevented from passing through the first end of support member S2 and is held against a cylinder head (not shown), preferably by means of hydraulic pressure. In FIG. 2*a,* cylinder C2 and support member S2 are at a relative rotational orientation where lands SE2 do not engage ears CE2. Ears CE2 can pass through gaps between lands SE2, and cylinder C2 can pass longitudinally through support member S2 and consequently move away from cylinder head (not shown). Support member S2 can be shaped to restrain movement of cylinder C2 to defined paths if desired. For example, support member S2 can comprise grooves to accommodate ears CE2 along a defined path of cylinder C2 as it drops into support member S2. Alternative embodiments include, for example, pins or lugs (not shown) extending from support S2 to cylinder C2. When the pins or lugs engage both support member S2 and cylinder C2, they prevent cylinder C2 from moving into support member S2. When the pins or lugs are disengaged from either support member S2 or cylinder C2, then cylinder C2 can move into support member S2.

FIGS. 3(*a, b*) is a longitudinal sectional view of a cylinder-to-support mounting according to the present invention. A head H3, a piston P3, and a cylinder C3 form a combustion chamber. Connecting rod CR3 connects piston P3 to the remainder of the engine (not shown). Generally cylindrical cylinder C3 includes a mounting end having a projecting ear portion CT3. A generally cylindrical support member S3 includes a mounting land ST3. Projecting ear portion CT3 extends from axis A3 a radial distance R1. The base CT3*a* of projecting ear portion CT3 extends from axis A3 a radial distance R4. Cylinder C3 extends from axis A3 a radial distance R3. Support member S3 defines an inner volume, open for a distance R2 away from axis A3. R2 can be greater than R3 and R4 to allow cylinder C3 to nest inside support member S3. R4 can be greater than R3.

Figure 3B:
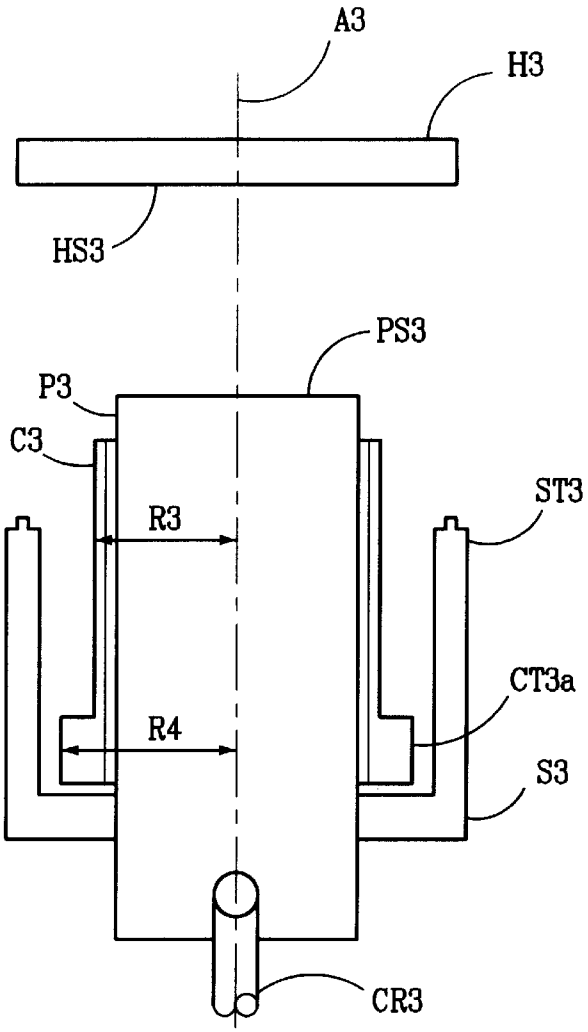
FIGS. 3(*a, b*) is a sectional view of a cylinder-to-support mounting according to the present invention.
Figure 3A:
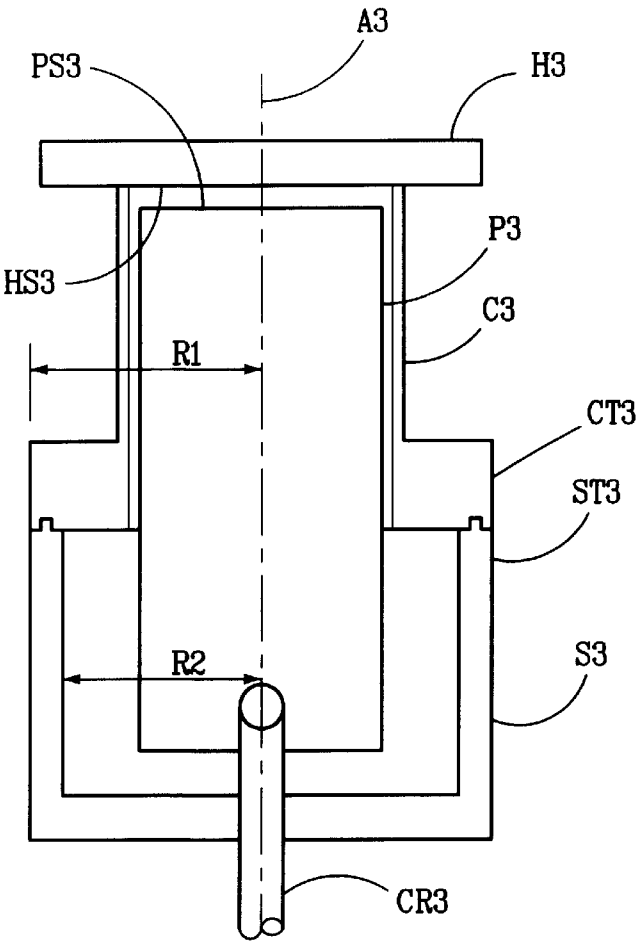

In FIG. 3*a,* cylinder C3 is rotated so that projecting ear portion CT3 engages mounting land ST3, preventing projecting ear portion CT3 and cylinder C3 from sliding past mounting land ST3 and into the open interior of support member S3. Head surface HS3 and piston surface PS3 form part of a combustion chamber, allowing the engine to operate. Surfaces HS3, PS3 are not accessible for inspection or cleaning. In alternative embodiments, projecting ear portions CT3 and mounting land ST3 can instead comprise matching threads, retractable ears, pins, or lugs instead of ears and lands.

In FIG. 3*b* cylinder C3 is shown after rotation to disengage projecting ear portion CT3 from mounting land ST3. Projecting ear portion CT3 and part of cylinder C3 have passed through mounting land ST3 and into the open interior of support member S3. The combustion chamber is now open, preventing operation of the engine E3. Head surface HS3 and piston surface PS3 are accessible for inspection and cleaning when cylinder C3 is within support member S3. The relative sizes of the various parts can be chosen so that any sealing rings mounted with piston P3 are contained by cylinder C3 even when cylinder C3 is nested within support member S3.

Figure 4:
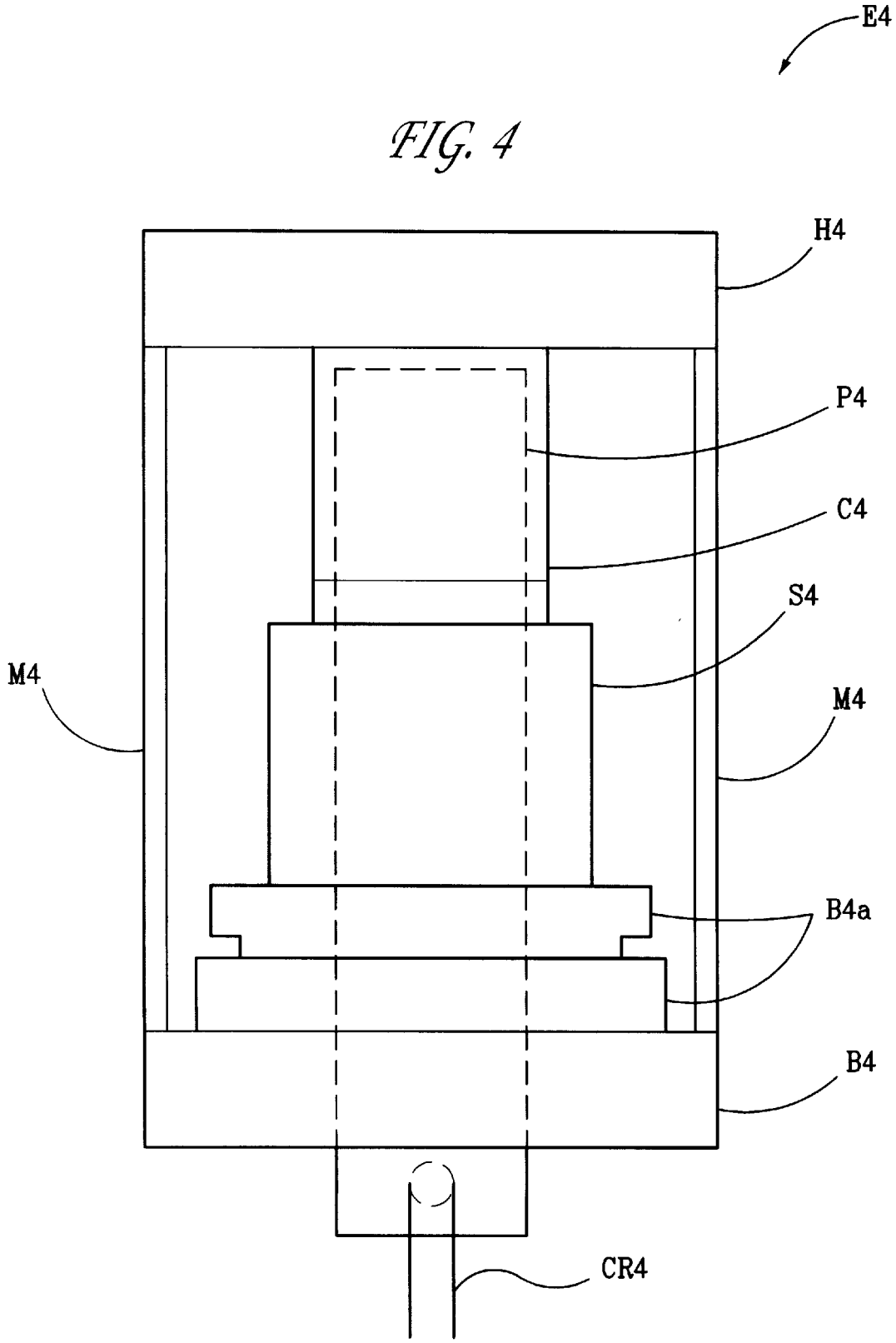
FIG. 4 is a side view of an engine according to the present invention.

FIG. 4 shows a side view of an engine E4 according to the present invention. Head H4 mounts with base B4 via mounts M4. Cylinder C4 sealingly engages head H4 and constrains piston P4. Connecting rod CR4 connects piston P4 (represented by dashed lines in the figure) to the rest of engine E4. Support member S4 mounts with cylinder C4 in a manner similar to that discussed before. Base B4 comprises stage B4*a.* Support member S4 mounts with stage B4*a.* Stage B4*a* is mobile between first and second positions. In the first position, stage B4*a* urges support member toward head H4. In the second position, stage B4 allows support member S4 and cylinder C4 to move away from head H4. Force exerted on support member S4 by stage B4*a* when in the first position can maintain the sealed engagement of head H4 by cylinder C4. Relief of force when stage B4*a* is in the second position can facilitate relative motion of cylinder C4 and support member S4 and subsequent disengagement of cylinder-to-support mounting. Stage B4*a* can comprise a hydraulic ram known to those skilled in the art.

Figure 5B:
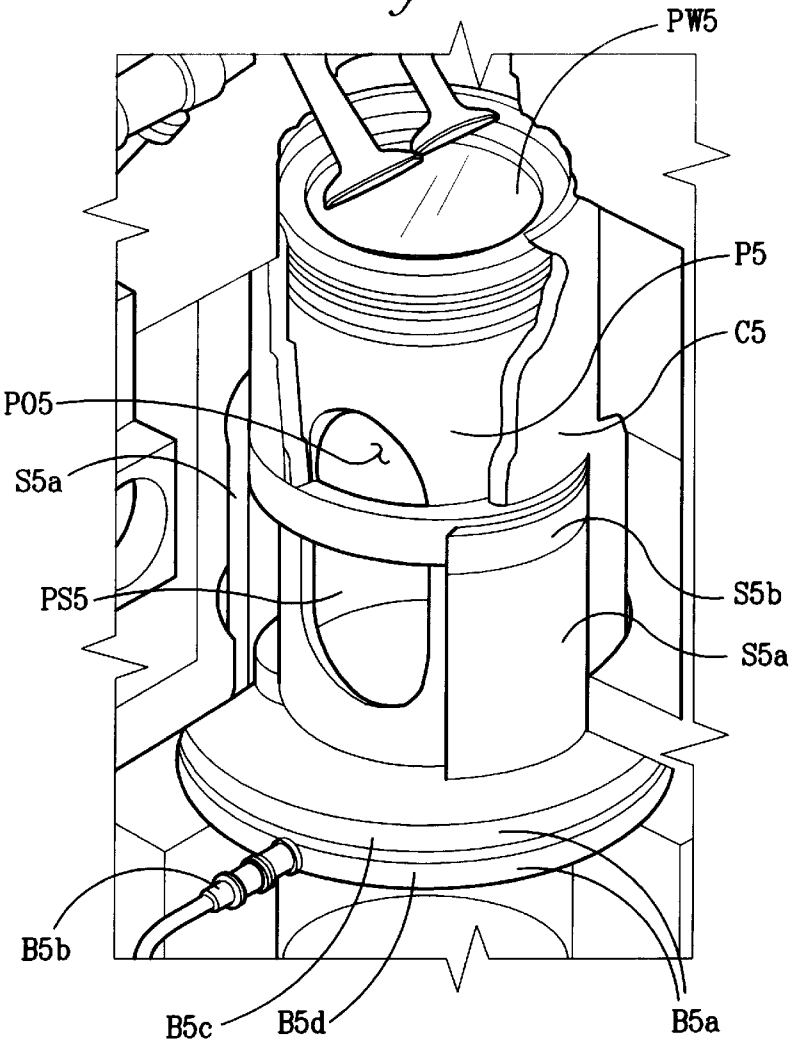
FIGS. 5(*a, b*) is a partially cutaway view of an engine according to the present invention.
Figure 5A:
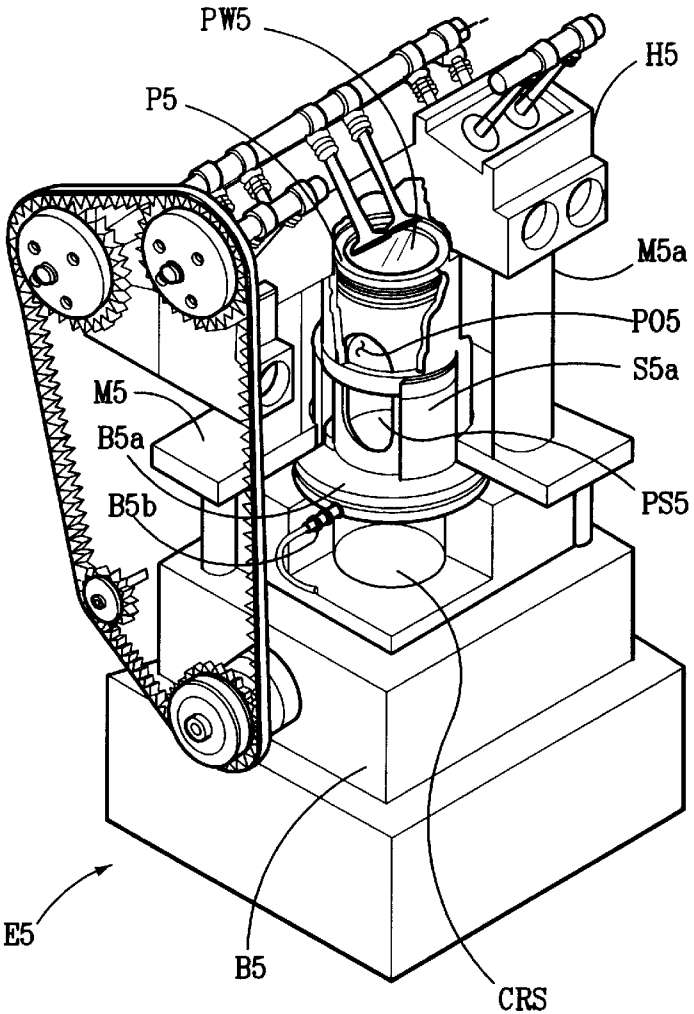

FIGS. 5(*a, b*) shows an engine E5 according to the present invention. The engine comprises a base engine block B5 to which is attached a short stroke hollow hydraulic cylinder B5*a,* a bolster plate M5, and an extended piston P5. Hydraulic line B5*b* supplies fluid to hydraulic cylinder B5*a*. Hydraulic cylinder B5*a* clamps piston cylinder C5 against head H5. Bolster plate M5 is a foundation for head supports M5*a*. Head supports M5*a* position head H5 at a greater distance from engine block B5 than in normal operation. Extended piston P5 has a hollow interior PO5 and at least one slot PS5 to allow optical access along the centerline of the piston P5 and through a window PW5 mounted in piston P5. In an alternative embodiment, a second slot (not shown) in P5, directly opposite slot PS5, provides for supporting an inclined mirror for optical access to the centerline of piston P5.

Hydraulic cylinder B5*a* comprises a donut-shaped stationary base B5*c* that projects into the bottom of a movable, donut-shaped hydraulic ram B5*d*. Hydraulic ram B5*d* sits over the hydraulic cylinder base B5*c*. The projection of hydraulic cylinder base B5*c* houses a large and a small U-cup seal which defines a fluid pressure region within hydraulic ram B5*d*. Hydraulic ram B5*d* can adjust to imperfections in the assembly when cylinder C5 is clamped against head H5 and additionally provides for differential expansion in various components. Bolted and pinned to the top of hydraulic ram B5*d* are two supports S5*a* that support member S5*b*. The top of supports S5*a* have a precisely machined circular key, concentric with the bore of hydraulic ram B5*d*. The key is lapped with a mating groove in support member S5*b*. Support member S5*b* has a locating ring to center the lower end of cylinder C5, and a circular locating groove to center support member S5*b* on support S5*a*.

Bolster plate M5 mounts securely with base engine block B5, centered around the base engine piston bore. Bolster plate M5 supports head supports M5*a,* hydraulic cylinder return springs (not visible in the Figure), hydraulic ram stop (not visible in the Figure), and hydraulic ram keys (not visible in the Figure). A cylinder locating plate (not visible in the Figure) mounts to the lower face of head H5 and rests on top of head supports M5*a*. Aligning features can be used (not visible in the Figure) with head supports M5 to center and guide cylinder C5 into cylinder locating plate (not visible in the Figure). Cylinder locating plate (not visible in the Figure) positions the top of cylinder C5 on centerline when hydraulic cylinder B5*a* is pressurized, causing the hydraulic ram B5*d* to move toward head H5.

To lower cylinder C5 and provide access to surfaces of piston P5 and head H5, support S5*b* can be rotated so that ears or similar mounting features disengage. Hydraulic cylinder B5*a* can be de-pressurized so that cylinder C5 and support S5 rest about 2 mm below their operating positions. Consequently, support S5*b* is free to rotate. Support S5*b* can be grasped manually or by pins, grooves, or other such features. Support S5*b* can then be rotated to disengage ears or manipulated to disengage other mounting features that otherwise prevent support S5*b* and cylinder C5 from dropping inside support S5*a*. Cylinder C5 and support S5*b* can then be lowered to rest inside support S5*a*. During descent, cylinder C5 is roughly guided by piston P5 with the top of cylinder C5. Precise guidance of the movement of cylinder C5 can be provided by various aligning features (not visible in the Figure) disclosed herein.

To return cylinder C5 to operating position, cylinder C5 and support S5*b* can be raised. At a point slightly above support S5*a,* support S5*b* can be rotated to engage ears or manipulated to engage other mounting features. Pressurizing hydraulic cylinder B5*a* can provide force to overcome hydraulic cylinder return springs (not visible in the Figure) and force the top of cylinder C5 against head H5. The interface between cylinder C5 and head H5 can be sealed with O-rings or flat gaskets. A plurality of spring plungers (not shown) can be uniformly spaced around hydraulic ram B5*d* to prevent the ram from tilting while hydraulic cylinder B5*a* is being pressurized.

The particular sizes and equipment discussed above are cited merely to illustrate particular embodiments of the invention. It is contemplated that the use of the invention may involve components having different sizes and characteristics. It is intended that the scope of the invention be defined by the claims appended hereto.

I claim:

1. A quick release engine cylinder comprising:

a) a hollow cylinder member, having walls defining an inner open cross-section, where the inner open cross-section is shaped to allow at least part of a piston to move therethrough, and having a first end and a second end, where the first end is adapted to sealingly engage a cylinder head;

b) a support member having first and second ends and an interior open cross-section shaped to allow at least part of the cylinder member to move therethrough;

c) means for holding the support member in a predetermined relationship to the cylinder head; and d) means for mating the second end of the cylinder member and the first end of the support member so that the second end of the cylinder member can not pass through the first end of the support member when the cylinder member is at a first selected orientation relative to the support member, and so that the second end of the cylinder member can pass through the first end of the support member when the cylinder member is at a second selected orientation relative to the support member, wherein the means for mating comprises a plurality of ears mounted with the second end of the cylinder member and extending radially away from the cylinder member's inner cross-section, and a plurality of slots in the first end of the support member, where the ears can pass through the slots when the ears and slots are in register.

2. The quick release engine cylinder of claim 1, wherein the means for mating comprises a plurality of cylinder ears mounted with the second end of the cylinder member and extending radially away from the cylinder member's inner cross-section, and a plurality of support lands mounted with a first end of the support member and extending toward the support member's inner cross-section, where the support lands engage the cylinder ears when the cylinder member is at the first selected orientation relative to the support member, and do not engage the cylinder ears when the cylinder member is at the second selected orientation relative to the support member.

3. The quick release engine cylinder of claim 1, wherein the means for mating comprises a male thread mounted with the second end of the cylinder member and a corresponding female thread mounted with the first end of the support member.

4. The quick release engine cylinder of claim 1, wherein the means for holding the support member comprises a base member having first and second ends, where the first end is mounted in a fixed relationship to the cylinder head and where the second end is mounted with the second end of the support member and is movable between first and second positions relative to the first end, where the support member and cylinder member are urged toward the cylinder head by the motion of the base member second end so that the cylinder member sealingly engages the cylinder head when the base member is at the second position.

5. The quick release engine cylinder of claim 4, wherein the base member comprises a hydraulic ram.

6. The quick release engine cylinder of claim 1, wherein the support member inner cross-section is shaped to constrain the cylinder member's outer cross-section to a selected path through the support member.

7. An engine comprising:

a) a cylinder head;

b) a piston having an outer cross-section;

c) a cylinder member, having walls defining an outer cross-section and an inner open cross-section, where the inner open cross-section is shaped to allow at least part of the piston to move therethrough, and having a first end and a second end, where the first end is adapted to sealingly engage the cylinder head;

d) a support member having a first end and a second end and an interior open cross-section shaped to allow at least part of the cylinder member to move therethrough;

e) means for holding the support member in a predetermined relationship to the cylinder head; and f) means for mating the second end of the cylinder member and the first end of the support member so that the second end of the cylinder member can not pass through the first end of the support member except when the cylinder member is at a selected orientation relative to the support member, wherein the means for mating comprises a plurality of cylinder ears mounted with the second end of the cylinder member and extending away from the cylinger member's inner cross-section, and a plurality of slots in the first end of the support member where the support member engages the cylinder ears except when the cylinder ears are in register with the slots.

8. The engine of claim 7, wherein the means for mating comprises a male thread mounted with the second end of the cylinder member and a corresponding female thread mounted with the first end of the support member.

9. The engine of claim 7, wherein the means for holding the support member comprises a base member having first and second ends, where the first end is mounted in a fixed relationship to the cylinder head and where the second end is mounted with the second end of the support member and is movable between first and second positions relative to the first end, where the support member and cylinder member are urged toward the cylinder head by the motion of the base member second end so that the cylinder member sealingly engages the cylinder head when the base member is at the second position.

10. The engine cylinder of claim 9, wherein the base member comprises a hydraulic ram.

11. The engine of claim 7, wherein the support member inner cross-section is shaped to constrain the cylinder member's outer cross-section to a selected path through the support member.

* * * * *